US006563470B2

(12) United States Patent
Em et al.

(10) Patent No.: US 6,563,470 B2
(45) Date of Patent: May 13, 2003

(54) DUAL BAND FREQUENCY POLARIZER USING CORRUGATED GEOMETRY PROFILE

(75) Inventors: Makkalon Em, Venice, CA (US); Charles W. Chandler, San Gabriel, CA (US); Louis C. Wilson, Canoga Park, CA (US)

(73) Assignee: Northrop Grumman Corporation, Redondo Beach, CA (US)

( * ) Notice: Subject to any disclaimer, the term of this patent is extended or adjusted under 35 U.S.C. 154(b) by 0 days.

(21) Appl. No.: 09/860,045

(22) Filed: May 17, 2001

(65) Prior Publication Data

US 2002/0171596 A1 Nov. 21, 2002

(51) Int. Cl.[7] ..... H01Q 19/00
(52) U.S. Cl. ..... 343/756; 343/771; 343/776
(58) Field of Search ..... 343/771, 772, 343/776, 756, 78.6, DIG. 2

(56) References Cited

U.S. PATENT DOCUMENTS 3,731,235 A * 5/1973 Ditullio et al. ..... 333/6
3,922,680 A * 11/1975 Alsberg et al. ..... 343/754
4,100,514 A 7/1978 DiTullio et al. ..... 333/31 A
4,228,410 A 10/1980 Goudey et al. ..... 333/122
4,412,222 A * 10/1983 Mobring ..... 343/779
4,467,292 A 8/1984 Ajioka et al. ..... 333/24.1
4,672,334 A * 6/1987 Saad ..... 333/157
5,578,972 A * 11/1996 Hadden et al. ..... 333/135
6,005,528 A * 12/1999 Preiss et al. ..... 343/786
RE37,218 E * 6/2001 Densmore et al. ..... 343/713
6,323,819 B1 * 11/2001 Ergene ..... 343/786

* cited by examiner

*Primary Examiner*—Don Wong
*Assistant Examiner*—Shih-Chao Chen
(74) *Attorney, Agent, or Firm*—Harness, Dickey & Pierce, P.L.C.

(57) ABSTRACT

An antenna system that employs an antenna element for both transmit and receive functions, where a dual band polarizer is used to convert linearly polarized signals to circularly polarized signals and vice versa for two frequency bands. The dual band polarizer includes a waveguide including corrugated structures extending from opposing sidewalls, where ridges in the structures extend perpendicular to the propagation direction of the signal. The height of the ridges taper from a lowest height at the ends of the waveguide to a largest height at the middle of the waveguide. The corrugated structures interact with the field components of the signal in the direction perpendicular to the ridges that cause that component to be delayed relative to the field components parallel to the ridges so that the signal changes accordingly and maintains the same magnitude.

19 Claims, 3 Drawing Sheets

DUAL BAND FREQUENCY POLARIZER USING CORRUGATED GEOMETRY PROFILE

BACKGROUND OF THE INVENTION

1. Field of the Invention

This invention relates generally to an antenna system employing a dual band frequency polarizer and, more particularly, to a satellite antenna system employing a dual band frequency polarizer, where the polarizer includes a waveguide having opposing corrugated structures that operate to convert a linearly polarized signal to a circularly polarized signal for a satellite downlink and convert a circular polarized signal to a linearly polarized signal for a satellite uplink, and vice versa.

2. Discussion of the Related Art

Various communications systems, such as certain telephone systems, cable television systems, internet systems, military communications systems, etc., make use of satellites orbiting the Earth to transfer signals. A satellite uplink communications signal is transmitted to the satellite from one or more ground stations, that retransmits the signal to another satellite or to the Earth as a satellite downlink communications signal to cover a desirable reception area depending on the particular use. The uplink and downlink signals are typically transmitted at different frequency bands. For example, the uplink signal may be transmitted at 30 GHz band and the downlink signal may be transmitted at 20 GHz band. The satellite is equipped with antenna systems including a number of antenna feeds that receive the uplink signals and transmit the downlink signals to the Earth.

For most of these satellite communications systems, one antenna system is provided for receiving the uplink signals and another antenna system is provided for transmitting the downlink signals. Each antenna system typically employs an array of antenna feed horns and one or more reflectors to collect and direct the signals. The uplink and downlink signals are circularly polarized so that the orientation of the reception antenna can be arbitrary relative to the incoming signal. To provide signal discrimination, one of the signals may be left hand circularly polarized (LHCP) and the other signal may be right hand circularly polarized (RHCP), where the signals rotate in opposite directions. Polarizers are employed in the antenna systems to convert the circularly polarized signals to linearly polarized signals suitable for propagation through a waveguide with low signal losses, and vice versa.

Because there are important weight and real estate limitations on a satellite, it is desirable to use the same antenna system for both transmitting the downlink signals and receiving the uplink signals. Because the uplink and downlink signals are at different frequency bands, the feed horns would have to be designed to transmit and receive the signals at both the uplink and downlink frequency bands. It would also be necessary to employ a dual band polarizer that could effectively convert the downlink signal from a linearly polarized signal to a circularly polarized signal and convert the uplink signal from a circularly polarized signal to a linearly polarized signal. However, known polarizers are only optimized for a single frequency band, making them unsuitable for polarizing signals of different frequency bands.

High frequency polarizers employing corrugated profiles are known in the art for converting a linearly polarized signal to a circularly polarized signal, and vice versa. For example, see U.S. Pat. No. 4,228,410 issued Oct. 14, 1980 to Goudey et al. However, the known corrugated polarizers of this type are not dual band polarizers that are able to polarize signals at two different frequency bands.

What is needed is a polarizer for an antenna system capable of transmitting a satellite downlink signal and receiving a satellite uplink signal, that is able to effectively provide polarization conversion in two separate frequency bands. It is therefore an object of the present invention to provide such a polarizer and antenna system.

SUMMARY OF THE INVENTION

In accordance with the teachings of the present invention, an antenna system is disclosed that employs antenna elements for both transmit and receive functions and a dual band polarizer to convert linearly polarized signals to circularly polarized signals and circularly polarized signals to linearly polarized signals for two separate frequency bands. The dual band polarizer is a waveguide device that includes a corrugated structure extending from opposing sidewalls, where ridges in the structures extend transverse to the propagation direction of the signals. The width of the ridges, the spacing between the ridges and the number of ridges are selected so that the polarization conversion is optimized for two frequency bands. Additionally, the height of the ridges taper from a lowest height at the ends of the waveguide to a largest height at the middle of the waveguide to minimize reflections. The corrugated structures interact with the field components of the signal in the direction perpendicular to the ridges to cause that component to be delayed relative to the field component parallel to the ridges, so that the polarization of the signal is changed accordingly.

Additional objects, advantages and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a dual band polarizer for use in an antenna system is merely exemplary in nature, and is in no way intended to limit the invention or its applications or uses. For example, the antenna system described below that employs the dual band polarizer of the invention is described in connection with a satellite communications system. However, as will be appreciated by those skilled in the art, the dual band polarizer has application for other communications systems other than satellite communications systems.

Figure 1:
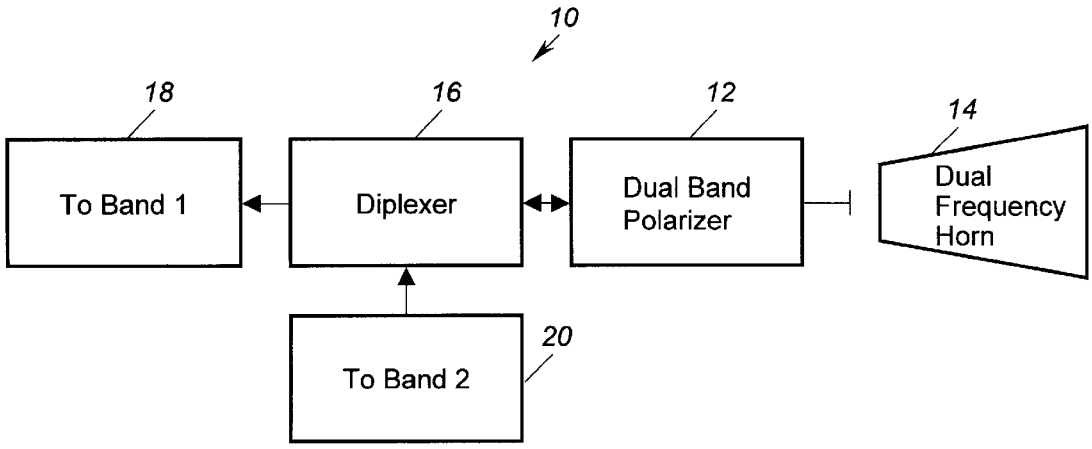
FIG. 1 is a block diagram of an antenna system employing a dual band polarizer, according to an embodiment of the present invention.

FIG. 1 is a block diagram of an antenna system 10 employing a dual band polarizer 12, according to the invention. The antenna system 10 also includes a dual band feed horn 14 that receives a satellite uplink signal at a particular frequency band, for example, 28–30 GHz or 40 GHz, and transmits a downlink signal at another frequency band, for example, 18.3–20.3 GHz. Only a single feed horn is shown in the antenna system 10, with the understanding that the antenna system 10 would include an array of feed horns arranged in a desirable manner depending on the particular application. The horn 14 is shown as a square or rectangular feed horn, but is intended to represent any feed horn operable in dual frequency bands having any suitable shape, including circular or elliptical shapes. The antenna system 10 may also employ reflectors and the like for collecting and directing the uplink and downlink signals, depending on the particular application. By using the antenna system 10, separate antenna systems are not needed for the satellite uplink and downlink signals, and therefore valuable space on the satellite can be conserved and the weight of the spacecraft can be reduced.

The satellite uplink and downlink signals are circularly polarized so that the orientation of the antenna element relative to the signal can be arbitrary. However, the use of linearly polarized signals is desirable in the antenna system so that they can propagate through waveguides without significant attenuation. Therefore, polarizers are necessary after the feed horn to convert the downlink signal from a linearly polarized signal to a circularly polarized signal, and for converting the uplink signal from a circularly polarized signal to a linearly polarized signal. According to the invention, the dual band polarizer 12 performs this function for both the uplink and downlink frequency bands, either separately in time or simultaneously. Particularly, circularly polarized signals received on the satellite uplink by the dual frequency feed horn 14 are converted to a linearly polarized signal by the polarizer 12, and the linearly polarized signals to be transmitted on the satellite downlink are converted to circularly polarized signals by the polarizer 12 before being sent to the feed horn 14. It has not heretofore been known in the art to provide a polarizer that can perform this function satisfactorily in two separate frequency bands.

The linearly polarized uplink signal from the polarizer 12 is sent to a waveguide diplexer 16 that directs the signal to reception circuitry 18 within the satellite communications system. Likewise, linearly polarized downlink signals from transmit circuitry 20 are sent to the diplexer 16 that directs the downlink signals to the polarizer 12 for transmission. The diplexer 16 can be any known waveguide device that is suitable for the purposes described herein, as would be well understood to those skilled in the art.

Figure 2:
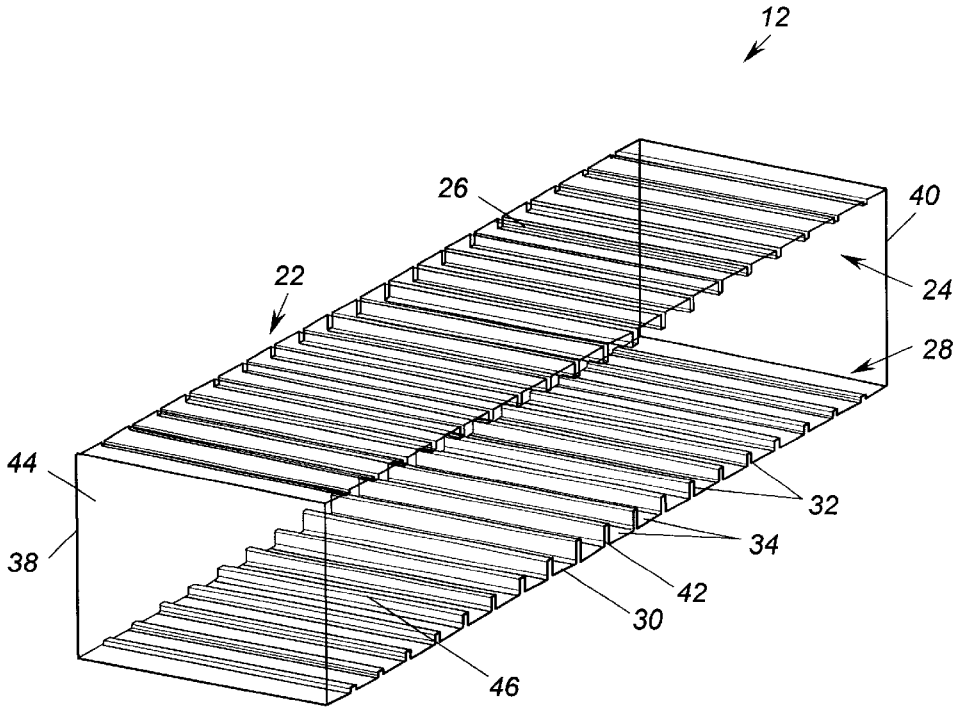
FIG. 2 is a perspective view of a the dual band polarizer used in the antenna system shown in FIG. 1, according to the invention.

FIG. 2 is a perspective view of the polarizer 12. In this embodiment, the polarizer 12 is a hallow, rectangular waveguide 22 that includes a first corrugated structure 24 extending from one sidewall 26 of the waveguide 22, and a second corrugated structure 28 extending from an opposing sidewall 30 of the waveguide 22. The corrugated structures 24 and 28 are identical, and therefore only the corrugated structure 28 will be described herein with the understanding that the corrugated structure 24 is the same. The corrugated structure 28 includes a plurality of parallel ribs 32 defining spaces 34 therebetween. The width of the ribs 32 and the width of the spaces 34 remain constant along the length of the waveguide 22. The height of each of the ribs 32 from the wall 30 is such that the corrugated structure 28 has a tapered configuration from one end 38 of the waveguide 22 to a center of the waveguide 22, and from the center of the waveguide 22 to an apposite end 40 of the waveguide 22. Particularly, the height of the ribs 32 proximate the ends 38 and 40 are at their lowest, and the height of the ribs 32 get progressively taller in a sequential manner towards the center of the waveguide 22. In this embodiment, the center rib 42 has the largest height. This tapering of the height of the ribs 32 significantly eliminates reflections of the signal that may occur from discontinuities within the waveguide 22. The other opposing side walls 44 and 46 of the waveguide 22 are smooth.

The signals enter the waveguide 22 through both ends 38 and 40. Because the waveguide is symmetric, the circularly polarized signal from the feed horn 14 or the linearly polarized signal from the diplexer 16 can enter either end. The signal propagating through the waveguide 22 has orthogonal $E_x$ and $E_y$ field components. The E-field component ($E_x$) that is perpendicular to the ribs 32 interacts therewith and is delayed relative to the E-field component ($E_y$) that is parallel or transverse to the ribs 32 and does not interact with the ribs 32. In other words, the spaces 34 between the ribs 32 act as waveguides that create a phase delay between the $E_x$ and $E_y$ field components. This delay causes the signal to rotate if the input signal is linearly polarized. The length of the waveguide 22 is selected so that the E-field components end up out of phase by 90 degrees at the output end creating circular polarization, and have the same magnitude. The orientation of the $E_x$ and $E_y$ field components relative to the ribs 32 determines which way the signal will rotate and whether the signal will be an RHCP or an LHCP signal. In a specific design, the E-field components of the linearly polarized downlink signal are oriented at an angle 45 degrees relative to perpendicular sides of the waveguide 22.

Alternately, the ribs 32 can speed up the E-field component that interacts with the ribs 32 to also create a phase discrepancy between the field components. When the circularly polarized signal is coming into the waveguide 22 from the opposite direction, the delay caused by the ribs 32 matches the phases of the E-field components so that by the time they reach the opposite end of the waveguide 22, they are in phase with each other, and have the same magnitude, making the signal linearly polarized.

The dimensions of the waveguide 22 and the dimensions and spacing of the ribs 32 and the numbers of ribs 32 are selected so that the lowest fundamental mode of the signal propagates through the waveguide 22, and the phase relationship between the E-field components are 90 degrees apart, as described above. These parameters are also dependent on the speed of the signal propagating through the waveguide 22 that is also frequency dependent. For dual band polarization conversion, these dimensions are selected so that the higher frequency band, here 30 or 40 GHz, will be polarized in the desirable manner. Then, the dimensions are optimized for the lower frequency band, here 20 GHz. In other words, the dimensions of the waveguide 22 are selected so that the components of the E-field are 90 degrees out of phase with each other for the high frequency, and then these values are slightly varied relative to each other to make the E-field components of the lower frequency band to also be 90 degrees out of phase with each other. The E-field components also have the same magnitude. This design criteria is possible because the lower frequency band is a subset of the higher frequency band. In the known corrugated structure polarizers, the spacing between the ribs was typically selected to be one-quarter of a wavelength of the center of the frequency band of interest. Typically only a few corrugations were necessary to perform the polarization conversion. However, in the design disclosed herein, that operates in two bands, the number of corrugations required is greater, typically on order of more than five.

In a particular design for the frequency bands discussed herein, the width of the walls 26, 30, 44 and 46 of the waveguide 22 are 0.456 inches, the thickness of the ribs 32 is 0.018 inches, the space 34 between the ribs 32 is 0.073 inches, the number of ribs 32 and the number of spaces 34 between the ribs 32 is thirty-nine and the length of the waveguide 22 is 1.802 inches. These parameters provide the desired polarization conversion for the uplink and downlink frequency bands of known satellite communication systems. For other frequency bands, these parameters will be different and optimized accordingly.

Figure 3A:
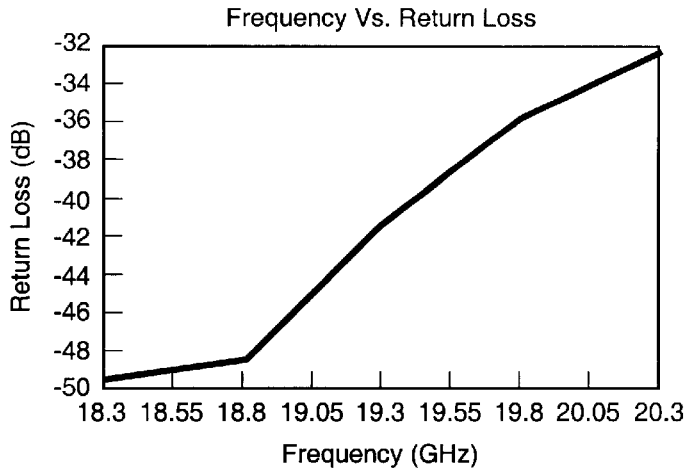
FIGS. 3(*a*)–3(*c*) are graphs showing frequency versus return loss, frequency versus axial ratio, and frequency versus cross-polarization, respectively, for a satellite uplink signal within the frequency range of 28–30 GHz that has been polarized by the polarizer of the invention.
Figure 3B:
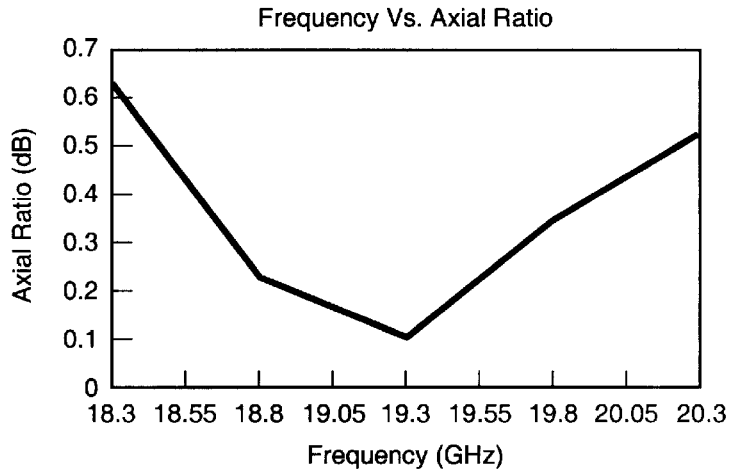
Figure 3C:
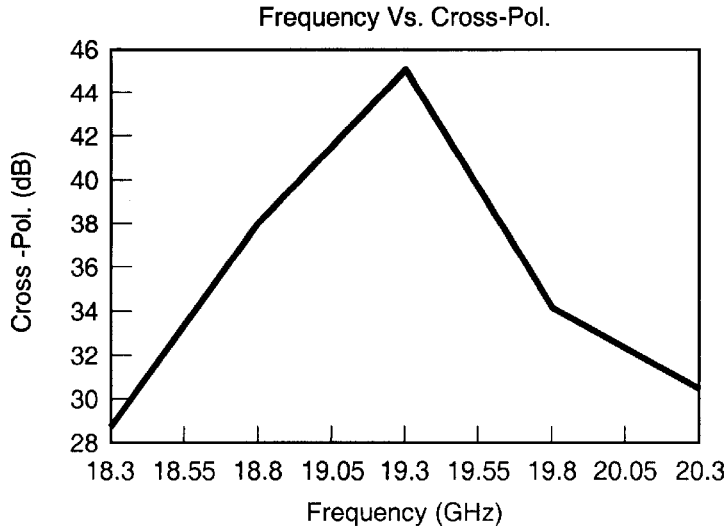
Figure 4A:
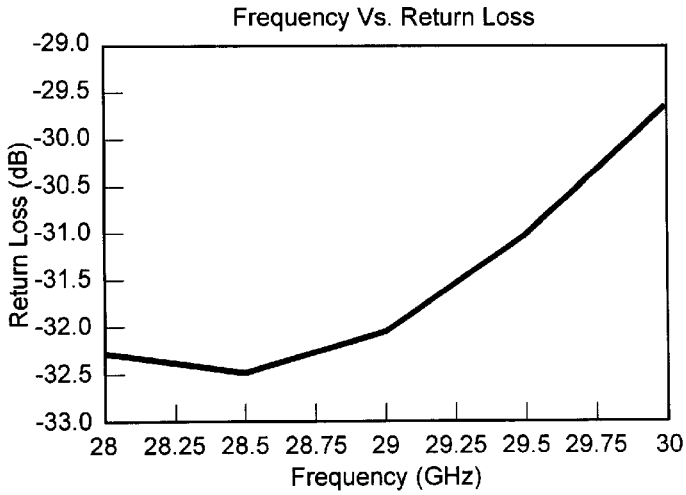
FIGS. 4(*a*)–4(*c*) are graphs showing frequency versus return loss, frequency versus axial ratio and frequency versus cross-polarization, respectively, for a satellite downlink signal within the frequency range of 18.3–20.2 GHz that has been polarized by the polarizer of the invention.
Figure 4B:
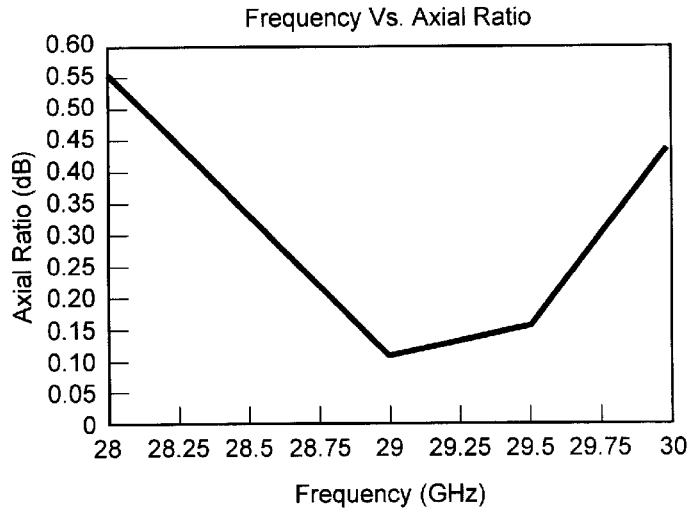
Figure 4C:
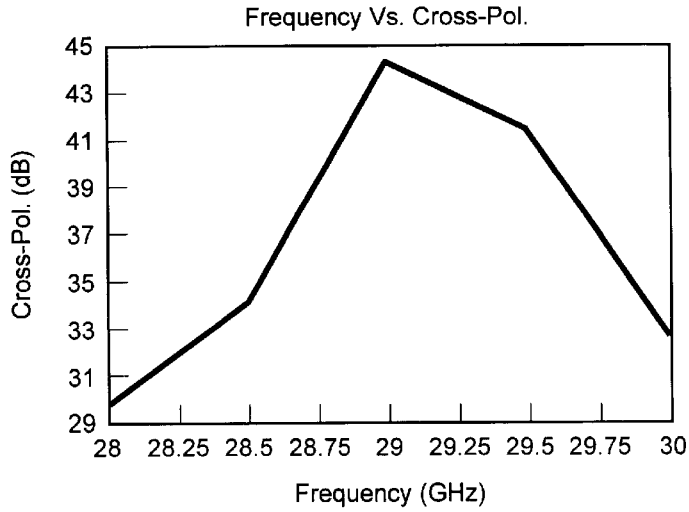

To show that the polarizer 12 provides good performance for the uplink and downlink frequency bands being discussed herein, FIGS. 3(*a*)–3(*c*) give performance criteria for the downlink frequency band and FIGS. 4(*a*)–4(*c*) give performance criteria for the uplink frequency band. Particularly, FIG. 3(*a*) shows the frequency versus return loss in dB, FIG. 3(*b*) shows the frequency versus axial ratio in dB, and FIG. 3(*c*) shows the frequency versus cross-polarization in dB. As is apparent, the performance is suitable for the downlink signal. Likewise, FIG. 4(*a*) gives frequency versus return loss in dB, FIG. 4(*b*) gives frequency versus axial ratio in dB and FIG. 4(*c*) gives frequency versus cross-polarization in dB. As is also apparent, suitable performance is also provided for the uplink frequency band.

The foregoing discussion discloses and describes merely exemplary embodiments of the present invention. One skilled in the art will readily recognize from such discussion and from the accompanying drawings and claims that various changes, modifications and variations can be made therein without departing from the spirit scope of the invention as defined in the following claims.

What is claimed is:

1. An antenna system comprising:

a dual frequency antenna element, said antenna element receiving a first signal having a first frequency band and transmitting a second signal having a second frequency band, said first and second frequency bands being different;

a dual frequency polarizer including a first end and a second end, said polarizer receiving the first signal at the first end and receiving the second signal at the second end, said polarizer converting the first signal from a circularly polarized signal to a linearly polarized signal and converting the second signal from a linearly polarized signal to a circularly polarized signal; and a diplexer receiving the linearly polarized first signal and the linearly polarized second signal, said diplexer directing the first signal to reception circuitry and directing the second signal to the polarizer.

2. The system according to claim 1 wherein the first signal is a satellite uplink signal and the second signal is a satellite downlink signal.

3. The system according to claim 1 wherein the polarizer includes a waveguide having two pairs of opposing side walls, wherein a first pair of the side wails include opposing corrugated structures, each corrugated structure including a plurality of parallel ribs, wherein all of the parallel ribs in the corrugated structures have about the same width.

4. The system according to claim 1 wherein the polarizer includes a waveguide having two pairs of opposing side walls, wherein a first pair of the side walls includes opposing corrugated structures, each corrugated structure including a plurality of parallel ribs, wherein the height of the ribs from the side walls is tapered in an increasing manner from each end of the waveguide towards a center of the waveguide.

5. An antenna system comprising:

a dual frequency antenna element, said antenna element receiving a first signal having a first frequency band and transmitting a second signal having a second frequency band, said first and second frequency bands being different;

a dual frequency polarizer including a first end and a second end, said polarizer receiving the first signal at the first end and receiving the second signal at the second end, said polarizer converting the first signal from a circularly polarized signal to a linearly polarized signal and converting the second signal from a linearly polarized signal to a circularly polarized signal, the polarizer including a waveguide including two pair of opposing side walls, a first pair of the side walls including corrugated structures, each corrugated structure including a plurality of parallel ribs, said ribs causing an E-field component of the first and second signals to be delayed relative to another E-field component so that the relative phases of the E-field components change as the signals propagate through the waveguide; and a diplexer receiving the linearly polarized first signal and the linearly polarized second signal, said diplexer directing the first signal to reception circuitry and directing the second signal to the polarizer.

6. The system according to claim 5 wherein the ribs are elongated rectangular ribs equally spaced from each other along the length of the waveguide.

7. The system according to claim 5 wherein the cross-section of the waveguide is square.

8. The system according to claim 5 wherein all of the parallel ribs the corrugated structures have about the same width.

9. The system according to claim 5 wherein the height of the ribs from the side wails is tapered in an increasing manner from each end of the waveguide towards the center of the waveguide.

10. An antenna system comprising:

a dual frequency antenna element, said antenna element receiving a first signal having a first frequency band and transmitting a second signal having a second frequency band, said first and second frequency bands being different;

a dual frequency polarizer, said polarizer converting the first signal from a circularly polarized signal to a linearly polarized signal and converting the second signal from a linearly polarized signal to a circularly polarized signal, the polarizer including a waveguide including two pair of opposing side walls, a first pair of the side walls including corrugated structures, each corrugated structure including a plurality of parallel ribs where the height of the ribs from the side walls is tapered in an increasing manner from each end of the waveguide towards the center of the waveguide, said ribs causing an E-field component of the first and second signals to be delayed relative to another E-field component so that the relative phases of the E-field components change as the signals propagate through the waveguide; and a diplexer receiving the linearly polarized first signal and the linearly polarized second signal, said diplexer directing the first signal to reception circuitry and directing the second signal to the polarizer.

11. An antenna system on a satellite for receiving satellite uplink signals and transmitting satellite downlink signals, said uplink signal and downlink signal having different frequency bands, said system comprising:

a dual frequency feed horn, said feed horn receiving the uplink signal and transmitting the downlink signal;

a dual frequency polarizer, said polarizer convening the uplink signal from a circularly polarized signal to a linearly polarized signal and convening the downlink signal from a linearly polarized signal to a circularly polarized signal, said polarizer including a waveguide having two pair of opposing side walls, a first pair of the side walls including corrugated structures, said corrugated structures including a plurality of parallel ribs, wherein the height of the ribs relative to the side wall is tapered in an increasing manner from each end of the waveguide towards the center of the waveguide, said waveguide receiving the uplink signal from the feed horn at a first end of the waveguide; and a diplexer receiving the linearly polarized uplink signal and the linearly polarized downlink signal, said diplexer directing the uplink signal to reception circuitry and directing the downlink signal to the waveguide at a second end of the waveguide opposite to the first end.

12. The system according to claim 11 wherein the ribs are elongated rectangular ribs equally spaced from each other along the length of the waveguide.

13. The system according to claim 11 wherein the cross-section of the waveguide is square.

14. The system according to claim 11 wherein the uplink signal has a frequency of 30 GHz and the downlink signal has a frequency of 20 GHz.

15. A dual frequency band polarizer for converting a linearly polarized signal to a circularly polarized signal in two separate frequency bands, said polarizer comprising:

a rectangular waveguide structure having a first end, a second end, a first pair of opposing side walls and a second pair of opposing side walls;

a first corrugated structure extending from a side wall of the first pair of side walls, said first corrugated structure including a plurality of parallel ribs extending in a direction transverse to the propagation direction of the signal; and a second corrugated structure extending from the opposing side wall of the first pair of side walls, said second corrugated structure including a plurality of parallel ribs extending in a direction transverse to the propagation direction of the signal, wherein all of the parallel ribs in the first and second corrugated structures have about the same width, said first and second corrugated structures being symmetrical relative to each other and interacting with an E-field component in the signal to delay the component to ornate the circular polarization for the signals in both frequency bands.

16. The polarizer according to claim 15 wherein the ribs are elongated rectangular ribs equally spaced from each other along the length of the waveguide.

17. The polarizer according to claim 15 wherein the cross-section of the waveguide is square.

18. The polarizer according to claim 15 wherein the height of the ribs from the side walls is tapered in an increasing manner from each end of the waveguide towards the center of the waveguide.

19. A dual frequency band polarizer for converting a linearly polarized signal to a circularly polarized signal in two separate frequency bands, said polarizer comprising:

a rectangular waveguide structure having a first end, a second end, a first pair of opposing side walls and a second pair of opposing side walls;

a first corrugated structure extending from a side wall of the first pair of side walls, said first corrugated structure including a plurality of parallel ribs extending in a direction transverse to the propagation direction of the signal; and a second corrugated structure extending from the opposing side wall of the first pair of side walls, said second corrugated structure including a plurality of parallel ribs extending in a direction transverse to the propagation direction of the signal, wherein the height of the ribs from the side walls is tapered in an increasing manner from each end of the waveguide towards the center of the waveguide, said first and second corrugated structures being symmetrical relative to each other and interacting with an E-field component in the signal to delay the component to create the circular polarization for the signals in born frequency bands.

* * * * *